United States Patent [19]

Dutcher

[11] 4,209,095

[45] Jun. 24, 1980

[54] CLOSURE FOR BLISTER CARD TYPE CONTAINER

[75] Inventor: Daniel P. Dutcher, Woodbury, Minn.

[73] Assignee: Champion International Corporation, Stamford, Conn.

[21] Appl. No.: 36,788

[22] Filed: May 7, 1979

[51] Int. Cl.[2] ..... B65D 73/00; B65D 5/54; B65D 65/18

[52] U.S. Cl. ..... 206/469; 206/621; 206/626

[58] Field of Search ..... 206/469, 621, 626, 467, 206/461

[56] References Cited

U.S. PATENT DOCUMENTS

| | | | |
|---|---|---|---|
| 3,101,884 | 8/1963 | Price | 206/626 |
| 3,255,880 | 6/1966 | Grossman | 206/469 |
| 3,279,596 | 10/1966 | Prym et al. | 206/469 |
| 3,599,787 | 8/1971 | Webster, Jr. | 206/469 |
| 3,854,652 | 12/1974 | Brackmann et al. | 206/626 |

*Primary Examiner*—William T. Dixson, Jr.

[57] ABSTRACT

A blister card type container comprising a thermoformed plastic enclosure bonded to one face of a paperstock card which forms a wall of the container includes locking structure formed integral with the card for locking a rectangular closure flap in the card in a closed position once the container is opened to prevent the accidental escape of contents from the container. The closure flap is hingedly connected along one edge thereof by a fold line to the card, while locking means provided integral with the card include first and second, spaced apart pairs of cut-lines in the card along one edge of the closure flap. One of the cut-lines in each of the pair thereof extend from one face of the card only partially into the latter and define a locking edge on the closure flap while the cut-line in each of the other pair thereof define locking flaps on the card. Upon initial opening of the closure flap, a tear line is created between the cutlines in the first and second pairs thereof, and the closure flap may be subsequently locked in its closed position by interposing the locking edges thereof between the first portion of the container and one side of the locking flaps.

1 Claim, 13 Drawing Figures

CLOSURE FOR BLISTER CARD TYPE CONTAINER

TECHNICAL FIELD

This invention generally relates to closure means for containers, and deals more particularly with structure for locking a closure flap in a container in its closed position to prevent accidental escape of articles therefrom.

BACKGROUND AND BRIEF DESCRIPTION OF THE INVENTION

Blister card type containers are being employed with increasing frequency by the packaging industry because of the manufacturing economy inherent such containers and also due to the fact that these containers lend themselves to various types of sale displays in which the containers are suspended from hooks or the like on a display stand. These containers are particularly adapted for packaging small articles and comprise a thermoformed, clear plastic enclosure portion having one side thereof essentially open and defined by a flat flange surrounding the opening, and a unitary card portion suitably joined to the face of the blister flange. A closure flap formed integral with the card is hingedly attached to the latter by a fold line in the paperstock, and is further defined by perforated score lines in the card. The consumer opens the container by pulling the closure flap away from the card, thereby tearing the score line and allowing the flap to be swung to an open position in order to gain access to the contents within the container.

Since manufacturing economy is a primary consideration in these type of container, it is undesirable to provide separate locking means thereon since the additional material and labor necessary to devise a locking means would add to the manufacturing cost of the container. Most desirably then, a means of locking the closure flap in its closed position once the user has opened the container is formed integral with the card and/or blister. In this respect, locking structure is disclosed in U.S. patent application Ser. No. 17,604, filed Mar. 5, 1979, and owned by the assignee of the present application, in the nature of a pivotable locking edge along one side of the closure flap which may be pivoted into overlapping relationship to one side of the flange of the blister opposite the card in order to lock the closure flap in its closed position. While this known design is suitable for some types of containers, it requires that the user carefully pivot the locking means into the proper attitude during the closing procedure and limits flexibility in the design of the container since the flange of the blister must be disposed immediately adjacent one edge of the closure flap when the latter is in it closed position.

The present invention overcomes the difficiencies in known prior art closures for blister card type containers by providing locking means which is not only quickly and easily manipulated by a user, but also eliminates the need for positioning the flange of the blister in a particular position with respect to the location of the closure flap in the card. According to the present invention, a blister card type container comprising a thermoformed, clear plastic enclosure bonded to one face of a paperstock card which forms a wall of the container includes locking means formed integral with the card for locking a rectangularly shaped closure flap in the card in a closed position once the container is opened to prevent the accidental escape of contents. The locking means includes a first and second spaced apart pair of cut-lines in the card along one edge of the closure flap. One of the cut-lines in each pair thereof extend from one face of the card only partially in the latter and define a locking edge on the closure flap, while another cut-line in each of the pairs thereof extend from the opposite end of the card partially into the latter and define locking flaps on the card. A tear is produced between cut-lines in each of the pairs thereof when a user initially swings the closure flap to its open position. As the closure flap is swung to its closed position, the yieldably flexible locking edges and locking flaps bend slightly to allow the locking edges to be shifted to a position between the locking flaps and the blister whereby to lock the closure flap in its closed position.

BRIEF DESCRIPTION OF THE DRAWINGS

In the drawings, which form an integral part of the specification and are to be read in conjunction therewith, and in which like parts are designated by like reference numerals in the various views.

DETAILED DESCRIPTION OF THE INVENTION

Figure 1:
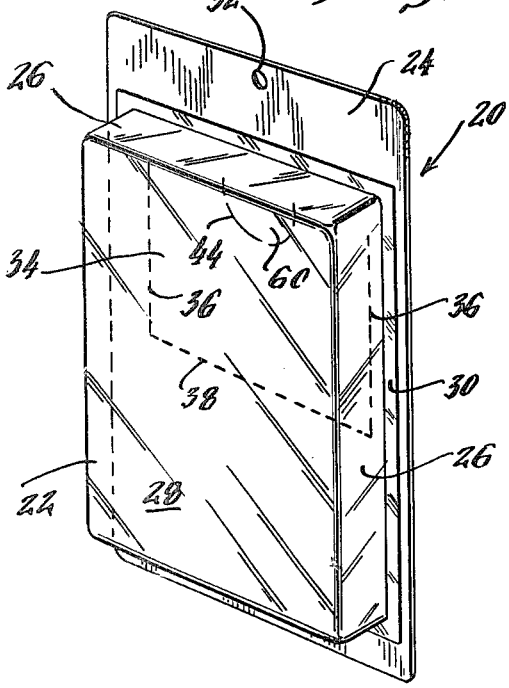
FIG. 1 is a perspective view of the container, empty of product, which forms the preferred embodiment of the present invention.
Figure 2:
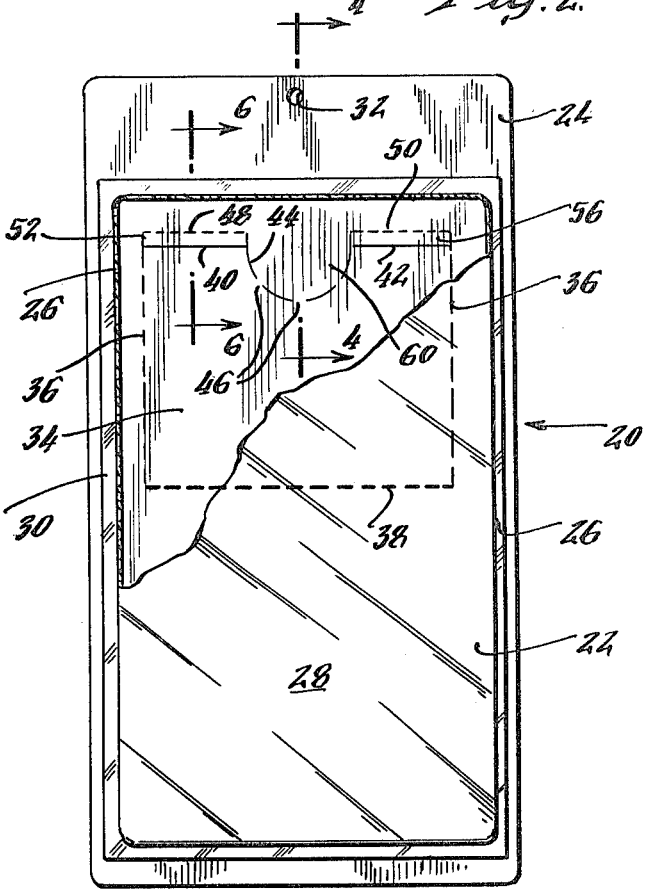
FIG. 2 is a front view of the container in FIG. 1, parts of the blister enclosure being broken away in section to better reveal the closure flap and associated locking means.
Figure 4:
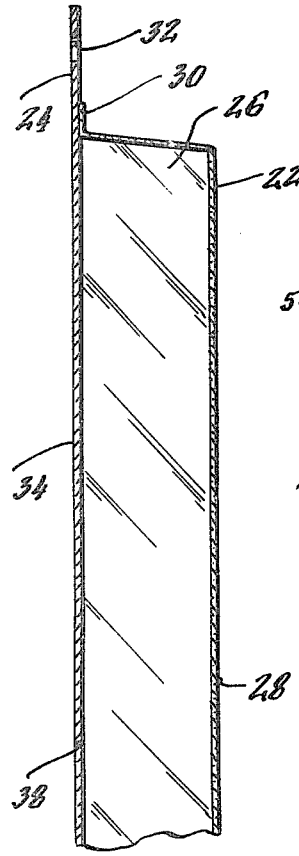
FIG. 4 is a sectional view taken along the line 4—4 in FIG. 2.
Figure 5:
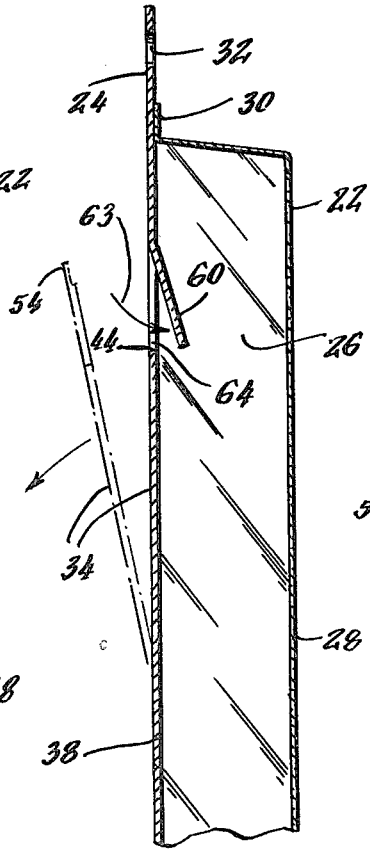
FIG. 5 is a view similar to FIG. 4, but showing the closure flap being swung in the direction of the arrow to its open position.
Figure 3:
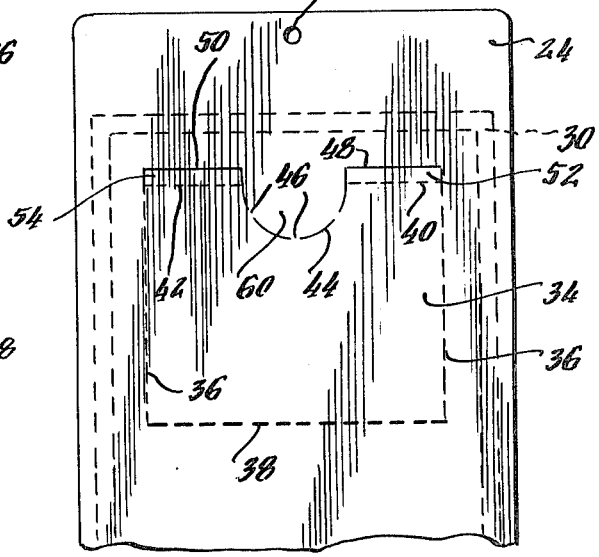
FIG. 3 is a fragmentary, rear view of upper portions of the container of FIG. 1, the marginal flange of the blister enclosure being indicated in the phantom.
Figure 6:
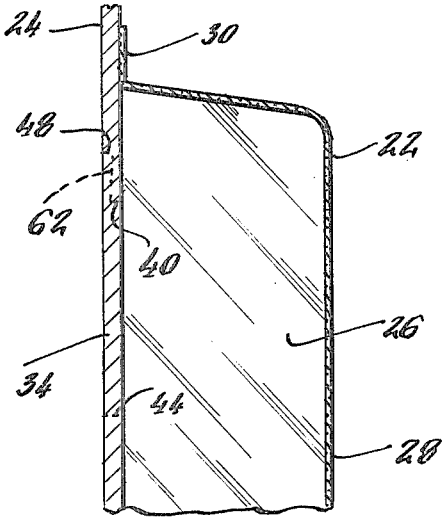
FIG. 6 is a cross-sectional view taken along line 6—6 in FIG. 2.
Figure 7:
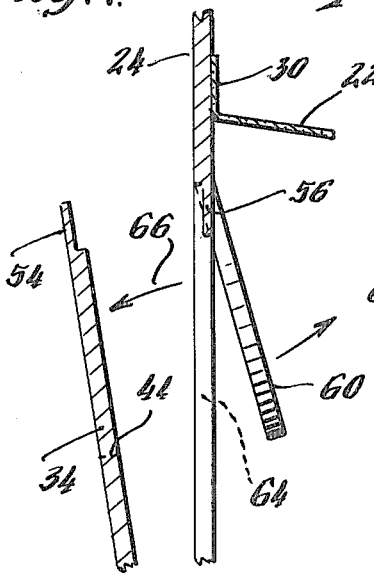
FIG. 7 is a cross-sectional view similar to FIG. 6 showing the locking means on an enlarged scale and the closure flap being swung to its open position.

Referring first to FIGS. 1–8, an easy opening, recloseable container generally indicated by the numeral 20 in FIG. 1 includes a first portion 22 which comprises a thermoformed blister enclosure of plastic material, and a second portion 24 which comprises a unitary card formed from a single sheet of paperstock.

The blister enclosure 22 includes side walls 26 and a front wall 28 which define an opening opposite the front wall 28 adjacent the card 24. The blister enclosure 22 is further provided with a marginal flange 30 circumscribing the edges thereof opposite the front wall 28, which flange 30 is suitably joined to one side of the card 24 as by thermobonding or the like.

Card 24 is rectangular in shape and may be provided with an aperture 32 to allow hanging of the container 20 for display or storage purposes. Card 24 further includes a generally rectangular, closure flap 34 in central portions thereof which has two opposite edges defined by parallel tear lines 36 produced by spaced apart score marks in the card 24, while a third edge of the closure flap 34 is defined by a fold line 38 extending perpendicular to the tear lines 36 and between the latter. The fourth side of the closure flap 34 is defined in part by a pair of spaced apart cut-lines 40 and 42 extending perpendicularly away from the tear lines 36 and toward each other, generally parallel to the fold line 38. Each of the cut-lines 40 and 42 extend only partially through the card 24, and do not penetrate the rear face of the card 24. An arcuately shaped cut-line 44 penetrating the entire thickness of the card 24 extends downwardly into the closure flap 34 and connects cut-lines 40 and 42, the opposing extremities of the arcuate cut line 44 extending upwardly past the cut-lines 40 and 42. In the preferred form, nicks 46 are provided at spaced intervals along the arcuate cut-line 44 thereby interrupting the latter and function to maintain a later discussed access tab 60 parallel with the card 24 until the container 20 is opened by a user.

Card 24 further includes a second pair of laterally spaced, partially penetrating cut-lines 48 and 50 in the rear face thereof 24 which are spaced above the respectively corresponding cut-lines 40 and 42 and extend parallel to the latter. Tear lines 36 extend past the outer lateral extremities of cut-lines 40 and 42 in a manner to connect cut-line 48 with cut-line 40, and cut-line 50 with cut-line 42. Similarly, the outer extremities of arcuate cut-line 44 connect the inner lateral extremities of cut-lines 40 and 48 as well as cut-lines 50 and 42.

The portions of the closure flap 34 between cut-lines 40 and 48 and between 42 and 50 define a respectively corresponding pair of rectangularly shaped, flexible locking edges 52 and 54. Similarly, the portions of the card 24 on the rear face thereof between cut-lines 40 and 48 and between 42 and 50 define rectangularly shaped, flexible locking flaps 56 and 58 respectively opposite the corresponding locking edges 52 and 54. Finally, the arcuate cut-line 44 defines a semicircularly shaped access tab 60 in the card 24 which covers a correspondingly shaped access notch used for opening the closure flap 34. As will become readily apparent hereinbelow, locking edges 52 and 54 along with locking flaps 56 and 58, in combination with the tear lines 36, provide locking means for holding the closure flap 34 in its closed position once a user has opened the container 20.

Assuming for the moment that the container is filled with product and a user wishes to open the latter in order to remove a portion of the product, the user first applies an inwardly directed force, as with a finger, to the access tab 60 in order to tear the nicks 46 and swing the access tab 60 in the direction of the arrow 63 inwardly toward the front wall 28 of the blister enclosure 22, thereby producing an access notch 64 in the card 24. A finger may then be inserted into the interior of the container through the access notch 64 to permit grasping opposite faces of the upper portion of closure flap 34. Closure flap 34 is then swung rearwardly in the direction of the arrow 66 about the fold line 38 to an open position whereby the user may gain access to the contents within the container 20 revealed by the opening in the card 24 which is defined by the closure flap 34. As the closure flap 34 is swung rearwardly, tension force is applied to the paperstock between the cut-lines 40 and 48 as well as between the cut-lines 42 and 50 which results in shearing thereof to produce a pair of tear lines respectively between cut-lines 40 and 48 and between 42 and 50, one of such tear lines being indicated at 62 in FIG. 8.

Figure 8:
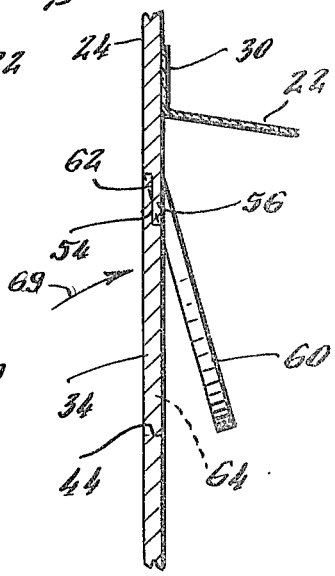
FIG. 8 is a cross-sectional view similar to FIG. 7 but showing the closure flap swung back to its closed position after the container has been opened.

The container is reclosed and locked by simply swinging the closure flap 34 in the direction of the arrow 69 until the locking edges 52 and 54 abuttingly engage the corresponding locking flaps 56 and 58 whereupon, with the application of additional force, the last mentioned locking edges and locking flaps bend, or flex, and slidably engage to each other as the closure flap 32 is swung slightly into the interior of the container 20 until finally, the locking edge 52 and 54 are disposed within the interior of the container 20 and have the rear faces thereof abuttingly contacting the front face of the locking flaps 56 and 58, whereby the locking edges 52 and 54 are interposed between the locking flaps 56 and 58 and the front wall 28 of the blister enclosure 22, as shown in FIG. 8. At this point, it is apparent that locking flaps 56 and 58 block the return travel of locking edges 52 and 54 thereby preventing the closure flap 34 from accidentally swinging to its opened position.

The user may later reopen the container 20 by inserting a finger through the access notch 64, gripping the closure flap 34 and swinging the latter outwardly about the fold line 38, whereupon the locking flaps 56 and 58 flexibly yield to the passage of the locking edges 52 and 54 therepast.

Figure 9:
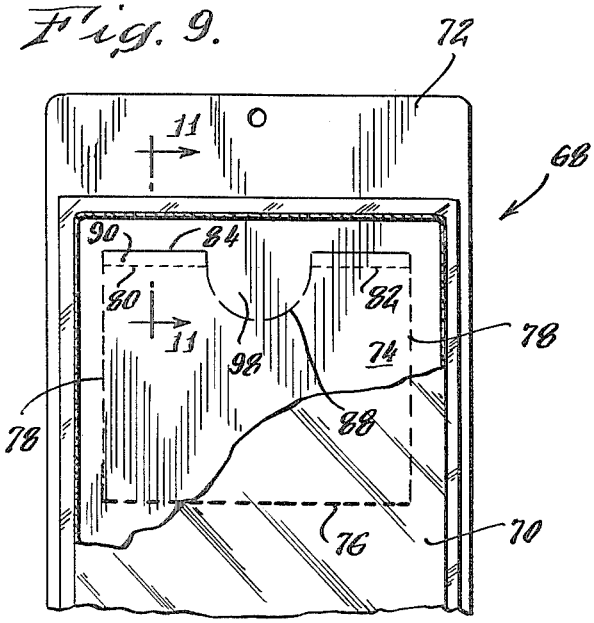
FIG. 9 is a fragmentary, front view of the upper portions of a container which forms another embodiment of the present invention, parts of the blister enclosure being broken away for clarity.
Figure 10:
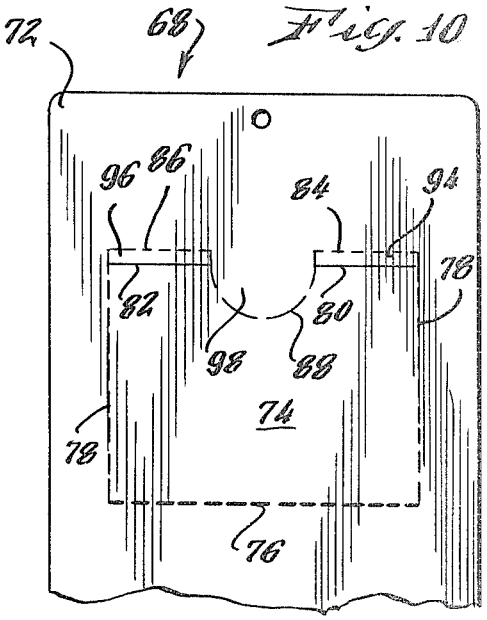
FIG. 10 is a fragmentary, rear view of upper portions of the container of FIG. 9.
Figure 11:
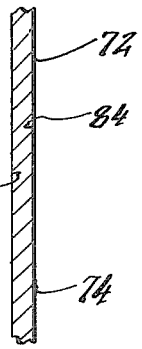
FIG. 11 is a cross-sectional view taken along the line 11—11 in FIG. 9.
Figure 12:
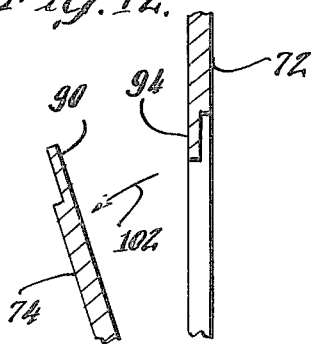
FIG. 12 is a view similar to FIG. 11 but showing the closure flap being swung into its open position.
Figure 13:
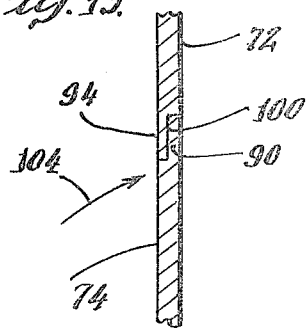
FIG. 13 is a view similar to FIG. 11 but showing the closure flap in its closed position after the container has been opened.

Referring now to FIGS. 9–13 wherein an alternate embodiment of the present invention is depicted, a container generally indicated by the numeral 68 in FIG. 9 includes a first portion comprising an enclosure 70, which is essentially identical to the blister enclosure 22 depicted in FIGS. 1–8, and further includes a second portion comprising a unitary, rectangularly shaped card 72 of paperstock.

Card 72 is provided with a rectangularly shaped, closure flap 74 essentially similar to the closure flap 34 previously described. Closure flap 74 is defined by fold line 76, a pair of opposing tear lines 78, a pair of spaced apart cut-lines 80 and 82 extending essentially parallel to the fold line 76 and only partially penetrating the card 72 from the rear face of the latter.

Another pair of spaced apart cut-lines 84 and 86 extend from the front face of the card 72 only partially through the latter toward the rear face thereof and are spaced immediately above the corresponding cut-lines 80 and 82. An arcuate cut-line 88 in the card 72 extends downwardly into the closure flap 74, while the outer extremities of the arcuate cut-line 88 connect the adjacent ends of cut-lines 84 and 80 as well as cut-lines 86 and 82. Tear lines 78 extend upwardly in the card 72 past the cut-lines 80 and 82 in a manner to connect the outer ends of the cut-lines 84 and 80 as well as cut-lines 86 and 82 whereby to define a pair of outer locking edges 90 and 92 on the top edge of the closure flap 74 adjacent the front face of the card 72. The aforementioned cut-lines further define a pair of spaced apart locking flaps 94 and 96 on the rear face of the card 72 opposite the locking edges 90 and 92. The arcuate cut-line 88 defines an access tab 98 which is operated in a manner similar to that described with reference to the embodiment shown in FIGS. 1–8.

In use, pressure is applied from the rear side of the card 72 to the upper corners of the closure flap 74, in a manner to urge the locking edges 90 and 92 toward the blister enclosure 70 whereby creating a tear line 100 between the cut-line 80 and 84 as well as between cut-lines 82 and 86. The access tab 98 is then depressed to permit grasping the closure flap 74 which is then pivoted in the direction of the arrow 102 outwardly to open the carton 68. As the closure flap 74 is opened, locking edges 90 and 92 slidably engage and flex along with, the corresponding locking flaps 94 and 96 to permit passage of edges 90 and 92 past flaps 94 and 96. Upon closing the closure flap 74 by swinging the same in the direction of the arrow 104, the locking edges 90 and 92 again slidably engage, and flex along with, the corresponding locking flaps 94 and 96 so that the locking edges 90 and 92 may be redisposed into interposed relationship between the locking flaps 94 and 96, and the blister enclosure 70 whereby the flaps 94 and 96, block outward swinging travel of the edges 90 and 92 and to lock the closure flap 74 in its closed position.

From the foregoing, it will be observed that the present container not only provides for the reliable accomplishment of the object of the invention, but does so in a simple and particularly effective manner. It is recognized, of course, that those skilled in the art may make various modifications or additions to the preferred embodiment chosen to illustrate the invention without departing from the gist and essence of the present contribution to the art. Accordingly, it is to be understood that the protection sought and to be afforded hereby should be deemed to extend to the subject matter claimed and all equivalents thereof fairly within the scope of the invention.

What is claimed is:

1. An easy opening, recloseable container comprising:

a generally trough-shaped plastic blister enclosure having a front portion and a tubular side wall, said blister enclosure further including a peripheral flange circumscribing the edges of said tubular side wall;

a generally rectangular unitary paperboard card having front and rear surfaces with said blister enclosure being bonded to the front surface of said card along the peripheral flange thereof thereby forming a wall of said container and sealing said blister enclosure, said card further including a generally rectangular closure flap disposed in the central portion of said card and spaced inwardly away from said tubular side wall of said blister enclosure, said closure flap being defined by a pair of cut lines along two opposed side edges thereof, with the bottom edge of said closure flap being hingedly connected to said card and with the top edge of said closure flap opposed to said hinge connection being defined by first and second spaced apart pairs of cut lines, with the cut line in each of said spaced apart pairs that is nearest said hinged connection extending from the rear surface of said card to a point intermediate the thickness thereof, and with the other cut line in each pair extending from the front surface of said card to a point intermediate the thickness thereof, said card further including an arcuate cut extending between and connecting said spaced apart pairs of cut lines and defining a shiftable tab, whereby to initially open said closure flap, said shiftable tab is pivoted inwardly into said blister enclosure such that an outwardly biasing force may be applied adjacent said spaced apart pairs of cut lines resulting in the shearing of the paperboard between said pairs of cut lines, which shearing functions to define interlocking, complementary L-shaped locking flaps along both the top edge of said closure flap and the top edge of the access opening defined by said closure flap, said L-shaped locking flaps flexing to allow said closure flap to be pivoted outwardly to its open position, and whereby when said closure flap is subsequently closed and opened, said L-shaped locking flaps flex to allow said L-shaped locking flaps to be respectively interlocked and disengaged.

* * * * *